US006383087B1

(12) United States Patent
Moser

(10) Patent No.: US 6,383,087 B1
(45) Date of Patent: May 7, 2002

(54) GOLF PUTTING ALIGNMENT SYSTEM AND METHOD

(76) Inventor: Jerald Moser, 524 S. Essex La., Mesa, AZ (US) 85208

( * ) Notice: Subject to any disclaimer, the term of this patent is extended or adjusted under 35 U.S.C. 154(b) by 0 days.

(21) Appl. No.: 09/779,773

(22) Filed: Feb. 8, 2001

(51) Int. Cl.[7] ..... A63B 53/06; A63B 69/36; A63B 57/00

(52) U.S. Cl. ..... 473/257; 473/220; 473/267

(58) Field of Search ..... 473/257, 251, 473/252, 267, 240, 220

(56) References Cited

U.S. PATENT DOCUMENTS

| | | | |
|---|---|---|---|
| 3,953,034 | A | 4/1976 | Nilson |
| 5,169,150 | A | 12/1992 | Tindale |
| 5,207,429 | A | 5/1993 | Walmsley |
| 5,452,897 | A | 9/1995 | Mick |
| 5,464,221 | A | 11/1995 | Carney |
| 5,464,222 | A | 11/1995 | Carney |
| 5,611,739 | A | 3/1997 | Carney |
| 5,707,296 | A | 1/1998 | Hodgson |
| 5,725,440 | A | 3/1998 | Finney |
| 5,818,036 | A | 10/1998 | Daly |
| 6,071,202 | A | 6/2000 | Densberger |
| 6,117,020 | A | 9/2000 | Currie |
| 6,123,626 | A | 9/2000 | Osborn |

*Primary Examiner*—Paul T. Sewell
*Assistant Examiner*—M. Chambers
(74) *Attorney, Agent, or Firm*—LaValle D. Ptak

(57) ABSTRACT

A laser aiming system and method is provided for determining the aiming tendencies of an individual golfer during putting. The system consists of two main parts. One of these parts is a housing with a laser in it for directing a beam of light parallel to the putting surface and at right angles to an imaginary line between a ball to be putted and a target hole. A mirror attached to the toe of the putter head is oriented perpendicular to the ball-striking surface of the putter head. The location of the laser beam is such that when the putter is in position to strike the ball, the projected beam of light is reflected from the mirror on the putter head back to the housing from which the laser beam is projected. The reflected beam strikes a 45° inclined mirror in the housing and reflects upwardly to an opaque indicating window, where the reflected laser beam spot is visible to the golfer. When the putter is correctly aimed, the spot is in the center of the window. When the putter is incorrectly oriented, the spot appears either closer to the target hole or farther away from the target hole on the opaque indicating window.

23 Claims, 4 Drawing Sheets

GOLF PUTTING ALIGNMENT SYSTEM AND METHOD

BACKGROUND

The game of golf is played by persons of widely varying abilities, from highly skilled professionals to amateurs who may play only a few times a year. The game is played on golf courses which generally have eighteen holes dispersed over an area which is landscaped to include a number of hazards, such as water, rough, sand traps (also known as bunkers), and trees or other vegetation designed to make the game have varying degrees of difficulty. Difficulty also is increased by varying the distances among the various holes. To begin the play for each hole, a ball is hit from a tee area and driven onto a fairway, or onto the green. At the end of each hole, which can vary in length, from the tee to the actual hole or cup on the green into which the ball must be placed, from about 100 to 600 yards, the ball usually must be putted to complete the play for that hole.

Repetitive practice is required to develop a consistent swing pattern for each of the different clubs involved in the play of the game of golf. Perhaps the most difficult, however, is the putter. In the putting portion of the game of golf, the object is to direct the ball across the putting green until it comes to rest in the hole or cup. Generally, the putting green is a smooth and closely cut grassy area surrounding the actual hole. Because of this type of surface on the putting green, a ball will roll relatively easily and rapidly when it is struck with even a light force. For a flat green, an accurately hit golf ball will travel along a straight path to the hole. Some greens, however, contain a slope to one side or the other, and a golfer tries to determine the proper target direction with which to strike the ball to allow the ball (once struck) to follow a proper curved path to the hole.

In every case, whether a ball is being putted on a straight line to the hole or at a different path to allow it to curve into the hole (in the case of a sloped green), it is necessary to accurately and squarely strike the ball in order to send it on its desired direction. A golfer's inability to accurately and consistently squarely strike or aim the ball with a putter, and smoothly swing the putter to effect this strike, is a major source of undesirable strokes on the score card of many golfers. It is difficult for most golfers to properly align the putter adjacent the ball to effect a square (right angle) striking of the ball when the ball is located even a short distance from the hole (on the order of 6 to 10 feet). This occurs since the golfer is generally unable to simultaneously see the ball, the club head, and the hole into which the ball is to be dropped. While this problem also exists when using other types of golf clubs, the reduction in the number of putts required by a golfer once the ball is placed on the green usually is the difference between a low score and a high score for any golfer, whether that golfer is a professional or an amateur.

In practicing putting, as well as for trainers who are assisting golfers in improving their putting game, it is difficult to accurately determine exactly what is happening at the moment of impact of the putter head with the ball. As a consequence, this is a most difficult part of the game to improve consistently. It is necessary for a golfer to develop a putting technique where after repetitive practice the golfer can intuitively know how he or she needs to swing the putter head to achieve right angle orientation of the club face to the desired direction of the ball, along with the proper "feel" for the amount of force required for putts of different lengths.

A number of devices have been developed to assist a golfer in practicing his or her putting game. Many of these devices employ the use of a beam of light or a laser line projected from the putter shaft or the putter head to assist the golfer in visually ascertaining the direction of travel which is to be imparted to a ball at the moment of impact. Several United States patents, all of which disclose the use of this general technique, include Nilson U.S. Pat. No. 3,953,034; Tindale U.S. Pat. No. 5,169,150, Walmsley U.S. Pat. No. 5,207,429; Carney U.S. Pat. No. 5,464,221; Carney U.S. Pat. No. 5,464,222; Carney U.S. Pat. No. 5,611,739; Hodgson U.S. Pat. No. 5,707,296; Finney U.S. Pat. No. 5,725,440 and Osborn U.S. Pat. No. 6,123,626. All of these patents require the mounting of some apparatus, such as a laser light source and its operating power supply, either on the putter shaft or on the putter head itself. All of these devices change the balance and the "feel" of a putter. They cannot be used in actual play of the game; so that if a golfer practices with such devices and develops a desirable technique, removal of the device from the putter shaft or the putter head causes the weight and balance distribution to vary. The putter, as used subsequently in actual golf play, then does not behave in the same manner it did when the training aid was attached. This is a serious disadvantages with such devices, since the putter itself must be modified in order to use the device.

A different approach for improving the sighting line of golfer using a putter is disclosed in the United States patent to Mick U.S. Pat. No. 5,452,897. In the Mick device, a laser light source is located behind the hole, and is directed across the hole to the ball which is to be putted. The golfer then assumes a normal ball hitting stance and addresses the ball with a special putter, and aligns the putter head adjacent the ball in a direction which the golfer believes to be the correct direction to the target. With the putter in this position, the golf ball is removed. A mirrored surface on the face of the putter head then reflects the light beam back to a target located at or behind the hole. The deviation between a line normal to the mirrored surface and the line between the location and the target is measured to determine the amount of deviation. Alignment lines on the putter head then are adjusted; and the operation is repeated. Once the reflected beam is aligned with the transmitted beam, the alignment lines are noted. The golfer then may acquire a golf club which has alignment lines oriented on the head corresponding to the ones which have been determined through the alignment procedure with the special putter. This device does not allow for repeated practice with a putter and a laser light source, and is simply used once to mark the alignment lines on the putter head.

The United States patent to Daly U.S. Pat. No. 5,818,036 also is directed to a laser light source located behind an indoor practice hole to direct a line of light across the hole and onto the floor. This line acts as a fixed guide to the hole or target. This is not a practical solution for outdoor use, because a laser line (usually red) has very low visibility in bright sunshine on the putting surface, or on the putter head. It also does not address the orientation of the putter face to the ball.

Another approach, which does not require the attachment of a device to the putter shaft or putter head, is disclosed in the United States patent to Densberger U.S. Pat. No. 6,071,202. This patent is for an optical system which is placed on the ground behind the putting position, and is directed across the ball toward the hole. A line of light in a vertical plane is designed to extend from the source across the ground, the ball and the hole, and across the top of the putter; so that the golfer can see this line throughout the putting stroke. There is nothing, however, which allows the golfer to actually determine the angle at which the face of the putter strikes the ball. In addition, this device may be difficult to use in actual outdoor golfing conditions, since bright sunlight may make it very difficult to observe the laser line projected on the ground, across the ball and to the hole.

Another attempt to assist a golfer in improving his or her putting game is disclosed in the United States patent to Currie U.S. Pat. No. 6,117,020. This patent uses an approach somewhat similar to that of Mick. In using the device of this patent, the golfer positions the putter to direct a golf ball toward a hole. Once the golfer places the striking face of the putter in what he or she believes to be the proper alignment, the golf ball is removed and replaced with the laser sighting device. The sighting device has a flat surface which is placed flush against the ball-striking face of the putter. The device then is turned on, projecting a laser light from the pointer to the golf hole. The light beam then provides an indication of whether a golfer is aiming to the left or to the right of a target line between the position of the golf ball and a hole or simulated-hole. The problem with this device, however, is that it does not function during an actual putt where the putter is moved from a back swing, back to the position where it continues on to strike the ball. Initial alignment is carefully made by the golfer, who then may somehow unknowingly alter this alignment during the back swing and forward stroke required to effect an actual putt.

It is desirable to provide a method and apparatus for enabling a golfer to determine the aiming tendency during an actual putting stroke, which overcomes the disadvantages of the prior art, which does not alter the balance and feel of the putter, which is easy to use and easy to interpret.

SUMMARY OF THE INVENTION

It is an object of this invention to provide an improved golfing aid.

It is another object of this invention to provide an improved putter aligning device and method.

It is an additional object of this invention to provide an improved putter aligning device and method employing a laser light source and a reflective surface carried by the head of the putter.

It is a further object of this invention to provide an improved device and method for determining the aiming tendency of an individual golfer during a putting stroke which utilizes a laser beam reflected from a surface perpendicular to the striking face of the putter head during an actual putting stroke.

In accordance with a preferred embodiment of this invention, a method and apparatus are disclosed for determining the aiming tendency of a golfer during a putting stroke. A mirror is placed on the toe of the putter head perpendicular to the ball-striking surface of the putter head. A collimated beam of light, which may be from a laser light source, is projected at a right angle to an imaginary line between a ball to be putted and a target hole. The beam is positioned to strike the mirror on the putter head when the head is in position to strike the ball. The beam reflected from the mirror on the putter head is used to provide an indication of the putter head orientation at the time the putter head strikes the ball.

DETAILED DESCRIPTION

Figure 1:
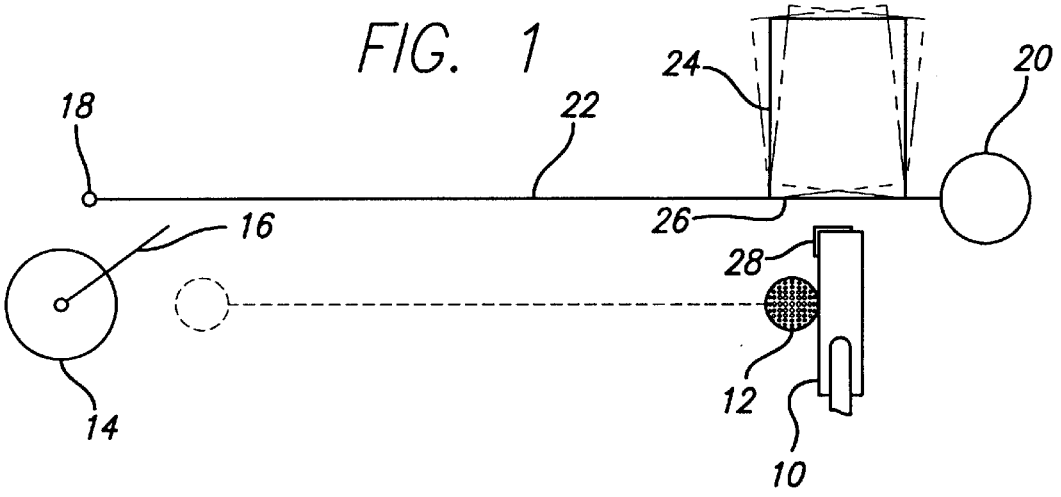
FIG. 1 is a top view of a preferred embodiment of the invention.
Figure 2:
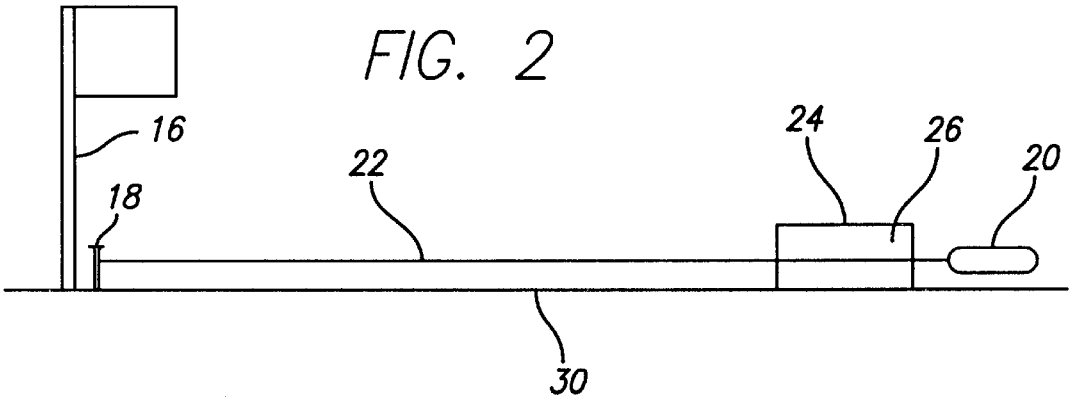
FIG. 2 is a side view of the embodiment shown in FIG. 1.

Reference now should be made to the drawings, in which the same numbers are used throughout the different figures to designate the same or similar components. FIGS. 1 and 2 are diagrammatic representations of a preferred embodiment of the invention, and illustrate a manner for initially setting it up for use in practicing the method of the invention.

As shown in the top view of FIG. 1, a putter head 10 is located in position to strike a golf ball 12 and drive it toward a hole 14. The desired path of the ball toward the hole is shown in dotted lines in FIG. 1; and this path will be followed by the ball 12 when the striking face of the putter head 10 is precisely at right angles or 90° to this dotted line path between the ball 12 and the hole 14. In setting up the device for practicing putts from the original position of the ball 12 to the hole 14, a pin, which typically may be in the form of a golf tee 18, is located adjacent the hole 14 and spaced a short distance from the desired path of the ball 12. A string reel 20 of the type typically used by golfers to measure the distance between a hole and a particular point on the green then is employed, with one end of the string 22 attached to the pin 18 and extended by the string reel 20 past the point where the ball 12 is located. The string 22 is spaced parallel to the desired path of the ball 12 about three to six inches from that path. As is apparent from FIGS. 1 and 2, the string 22 is pulled beyond the location of a putter head 10 which will be used to strike the ball 12.

When the string 22 is in the position shown in FIG. 1, a laser aiming device housing 24 has a flat front surface 26 placed against the string, parallel to it, to align a laser beam projected through the front surface 26 perpendicular to that surface. This alignment is relatively easy to accomplish, and can be done in a very short of time. As indicated in FIG. 1 in dotted lines, if the laser aiming device housing 24 is rotated one way or the other with respect to the string 22, the face 26 will not be parallel to the string 22. Once the laser aiming device housing 24 is located as shown in FIGS. 1 and 2, it may be pinned to the ground to temporarily hold it in place during a practice putting session.

Figure 3:
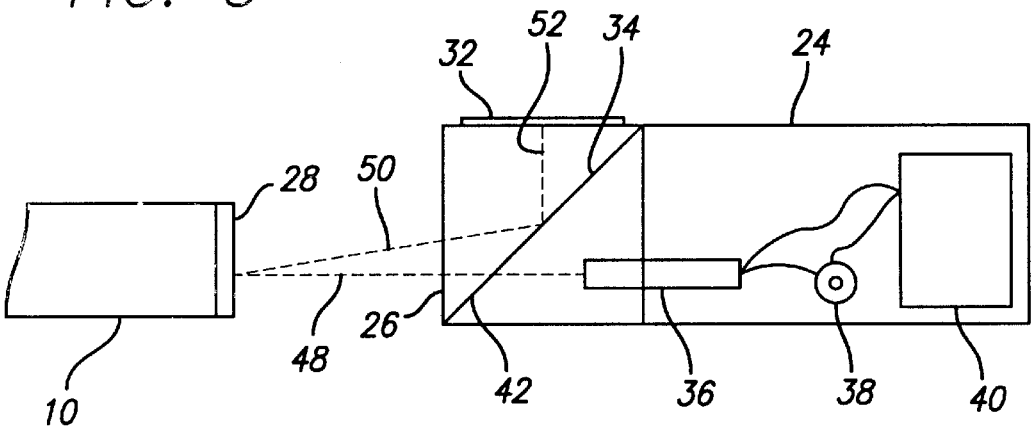
FIG. 3 is a more detailed side view of the embodiment shown in FIGS. 1 and 2.
Figure 4:
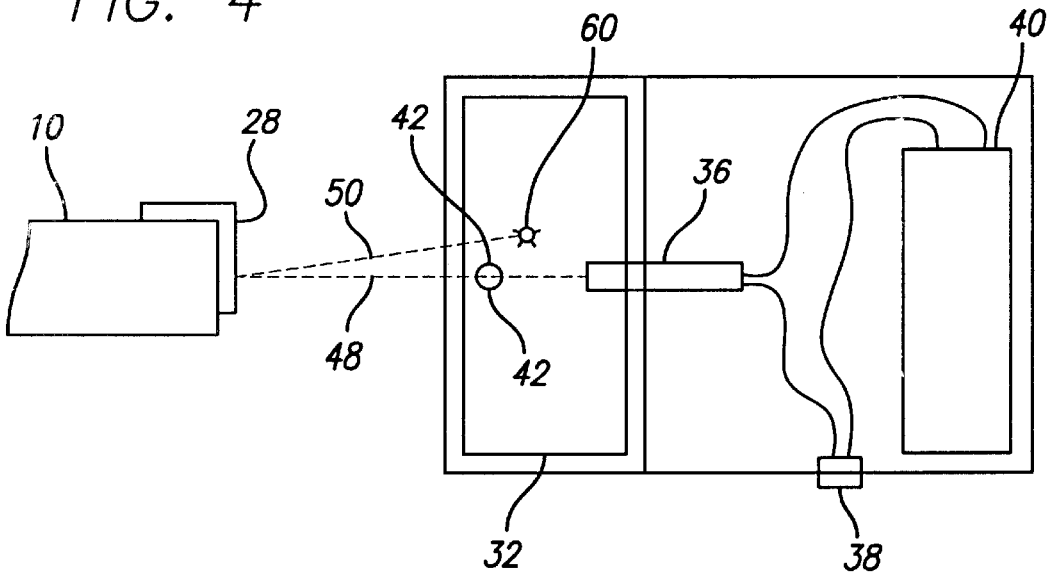
FIG. 4 is a more detailed top view of the embodiment shown in FIG. 3.

FIGS. 3 and 4 illustrate additional details of the laser aiming device and of the putter head itself when the putter head is utilized to practice the method of this invention. As shown most clearly in FIGS. 3 and 4, and also as shown in FIG. 1, the putter head has a lightweight, right-angle, plastic mirror 28 having an L-shaped cross-section removably secured to the flat front or striking face of the putter head 10, and extending at right angles over the toe of the putter head 10. The face of the mirror 28 on the toe has a reflective mirror surface, which may be provided by a reflective film or any other suitable material. The weight of the mirror 28 is a fraction of an ounce; so that it does not in any way affect the much greater weight and balance of the putter head 10 and the shaft to which the head is attached. Typically, the L-shaped reflector mirror 28 may be attached to and removed from the putter head 10 by means of a releasable adhesive surface on the side of the device 28, which contacts the flat striking face of the putter head 10. Double-sided sticky tape, or other suitable materials also may be used.

The housing 24 is shown in diagrammatic breakaway representation in both the side view of FIG. 3 and the top view of FIG. 4 to show the location of a laser light source 36 (or other suitable collimated light source) connected to a battery supply 40 through a switch 38. Since the operating circuit for the laser light source 36 and the light source 36 itself all are standard components, no additional details are considered necessary. The light source 36 is mounted slightly above the bottom of the housing 24 and it is centered from side-to-side, as illustrated in FIGS. 3 and 4. A collimated light beam 48, which is projected by the light source 36, is projected through a hole 42 in a mirror 34, the reflective surface of which is mounted at a 45° angle with respect to the light source 36 to reflect upwardly any light striking the reflective surface (the left-hand surface shown in FIG. 3) of the mirror 34.

When the device is used, a putter head 10 moved into position to strike the ball 12, as shown in FIG. 1, causes the reflective surface of the mirror 28 to encounter the projected beam 48. The beam 48 then is reflected from the surface 28 onto the 45° angled surface of the mirror 34, and upwardly to form a spot 60 on an opaque indicating window 32 located in the top of the housing 24 above the mirror 34 as clearly shown in FIGS. 3 and 4.

If the striking surface of the putter head 10 is precisely aligned perpendicular to the desired line of travel of the ball 12, as determined by the orientation of the front face 26 of the laser aiming housing 24, the projected spot 60 of the reflected beam 50 back onto the mirror 34 will appear on the opaque window 32 somewhere near its center, directly over the line of the projected beam 48.

Figure 5:
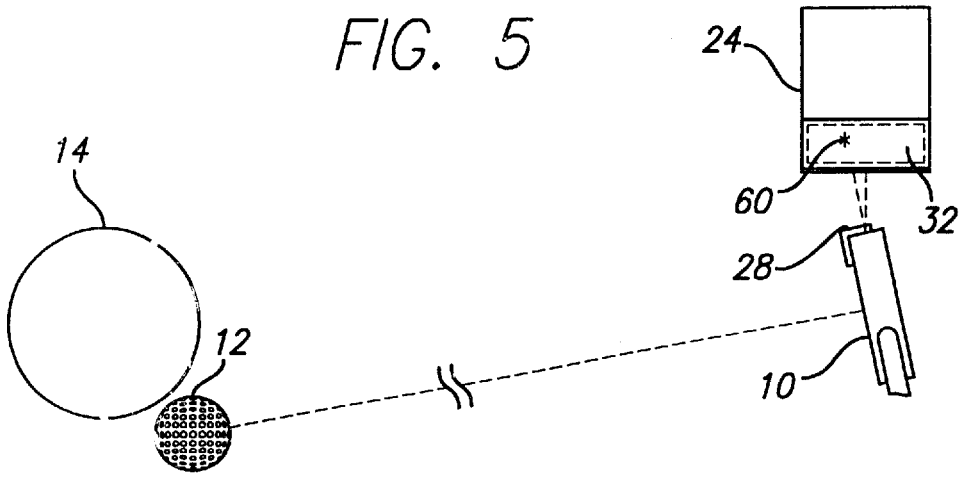
FIGS. 5, 6 and 7 are diagrammatic illustrations of the function and operation of the embodiment shown in FIGS. 1 and 2.
Figure 6:
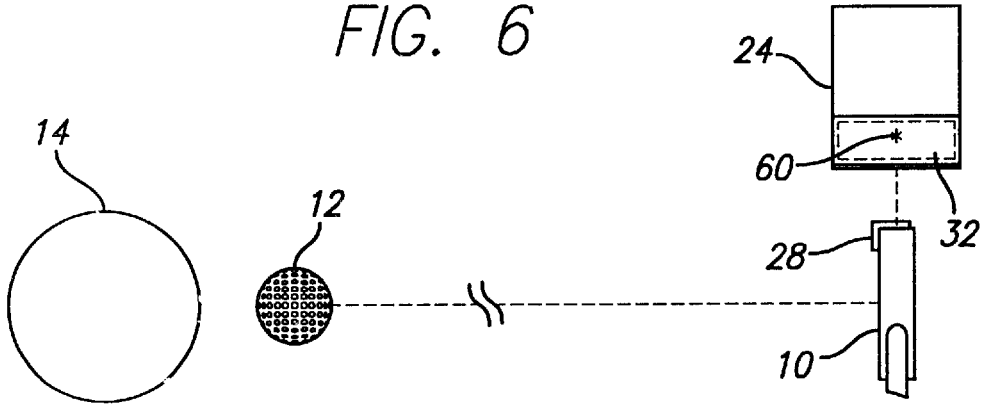
Figure 7:
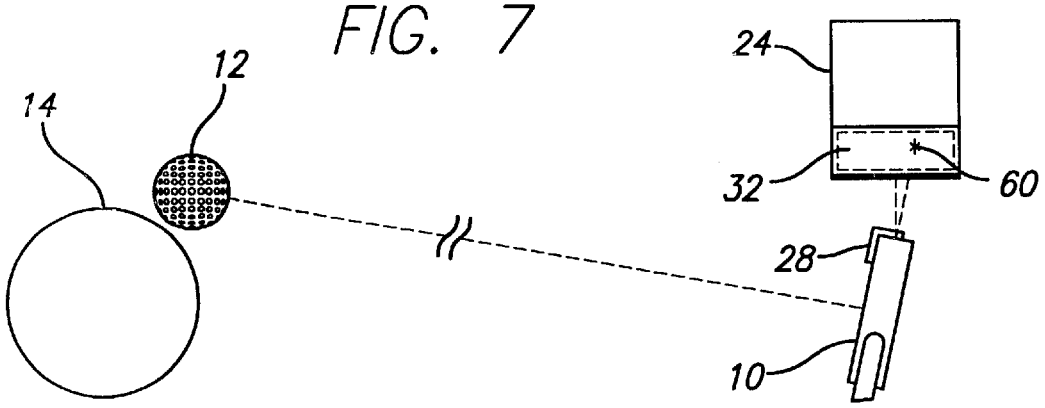

If, however, the striking face of the putter head 10 is at an angle other than perpendicular to the desired line of travel of the golf ball 10, the reflected beam 50 will not be in alignment with or overlie the projected beam 48, but will deviate depending upon the angular position of the striking surface of the putter head 10. This is illustrated in FIGS. 5, 6 and 7. FIG. 6 is a properly aligned orientation of the striking face of the putter head 10, and shows the reflected spot 60 centrally located in alignment with the projected beam on the opaque window 32.

When the striking surface of the putter head 10 is turned slightly toward the golfer, it is in position called a "closed face" position. In this position, the ball 12, when it is struck by the putter head 10, will move on a path to a position to the left of (below in FIG. 5) the hole 14, as illustrated in FIG. 5. This is indicated by the spot 60 located closer toward the hole 14 in the window 32 for such an orientation of the striking surface of the putter head 10.

On the other hand, if the putter head 10 is tilted away from the golfer at the time of contact with the ball 12, an "open face" condition exists; and the ball 12 will move to the right of the hole 14 (above it as shown in FIG. 7). This causes the indicator spot 60 to be located farther away from the target hole to the right of center in the window 32 (as viewed in FIG. 7).

Whenever the putter head is properly aligned at the time of the striking of the ball 12, the spot 60 will be centered in the opaque window 32 along the line of transmission of the beam 48 from the laser 26, as illustrated in FIG. 6. When a golfer uses this device to monitor the putting stroke, slight adjustments may be made for successive putts until every one of the putts is in the aligned position as shown in FIG. 6. When this occurs, the golfer, after repeated practice putts, can determine the proper feel of a properly aligned putt, as well as the striking force required to place the ball in the hole 14. This device and method allows easy and accurate practice development for establishing the characteristics to provide improved putting for any golfer.

It should be noted that in order to preserve the life of the battery 40, it is desirable to switch the laser 36 on only at or slightly before the time a putter head 10 actually is used to address and strike a ball 12 to send it toward a hole 14. Consequently, the switch 38 may be a remotely controlled on and off switching mechanism of the type commonly used for operating television sets and other electrical appliances. When the device is used particularly in conjunction with an instructor, the instructor generally controls the on/off switching of the laser 36; so that energy is conserved and the projection of the beam 48 is effected only when the mirrored surface of the device 28 is at or near the aligned position shown in FIGS. 3 through 7.

Alternatively, an inductive ring may be provided around the front surface 26 of the housing 24 to detect the presence of the metal mass of a putter head 10 as it swings into close proximity to the housing 24 to operate the switch 38 between the power supply and the laser 36 to cause power to be switched on only when the putter head 10 is located in close proximity to the front of the housing 24, as for example, shown in FIGS. 3, 4, 5, 6 and 7.

Figure 8:
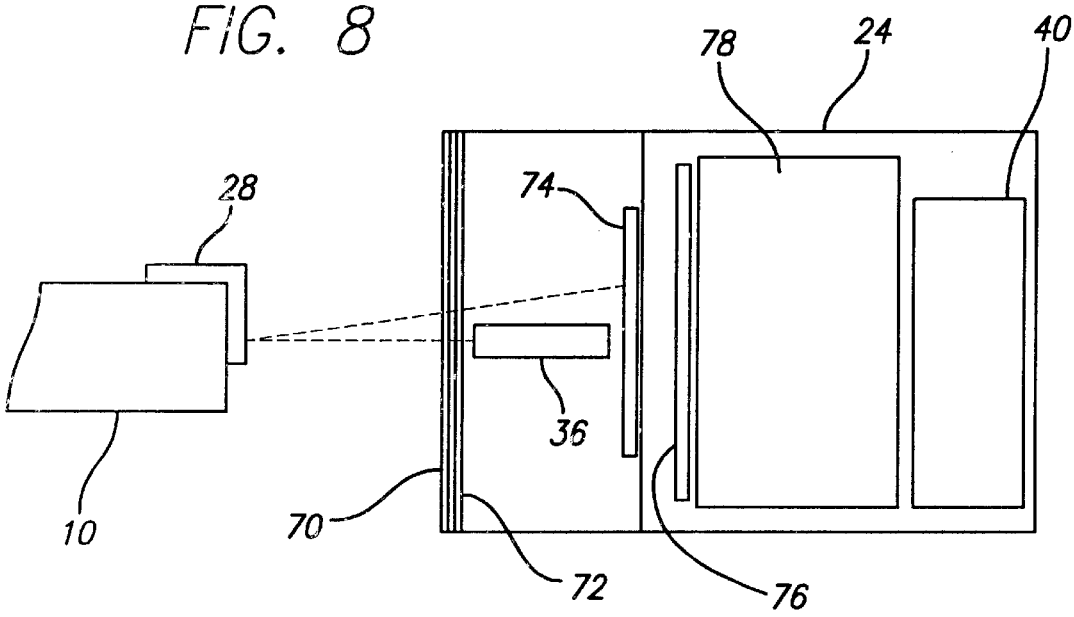
FIG. 8 is a top view of an alternative embodiment of the invention.
Figure 9:
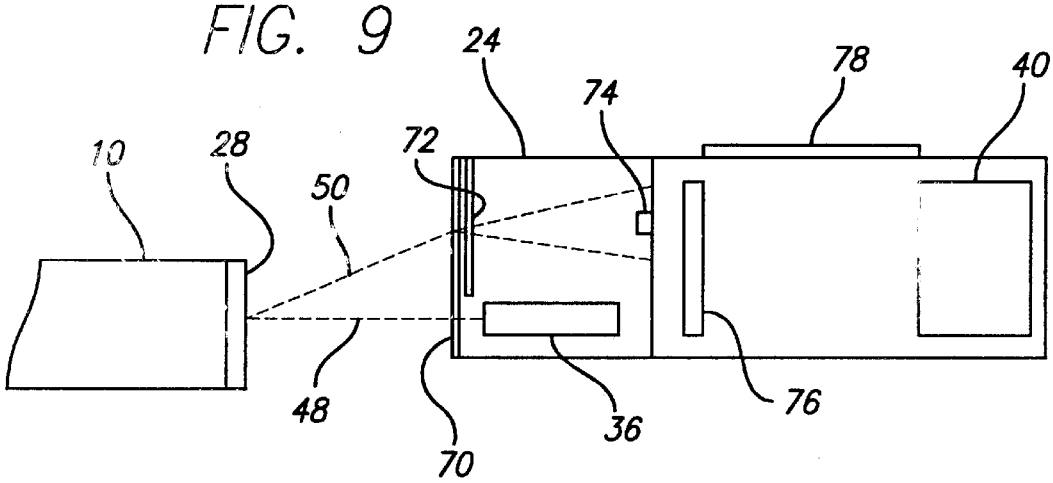
FIG. 9 is a side view of the embodiment shown in FIG. 8.

FIGS. 8 and 9 are directed to a variation of the embodiment of FIGS. 3 and 4, but which operates in the same manner insofar as a golfer is concerned. The putter head 10 and reflective mirror 28 are employed in the same manner as described previously. The housing 24 for the laser device 36, however, is provided with an inductive ring 70 around its front face, as discussed above, to switch the laser 36 on whenever a putter head 10 is brought into close proximity to the housing 24. The projected laser beam 48 is directed in the same manner to the reflective surface of the mirror 28, which then reflects the beam 50 back to the front face of the housing 24, as described previously.

FIG. 8 is a top view of the modified device; and FIG. 9 is a side view comparable to the views of FIGS. 4 and 3, respectively. In place of the angled mirror 34, however, the device of FIGS. 8 and 9 includes a line prism lens 72 located to receive the reflected beam of light 50. The lens 72 then bends the beam 50 to direct it onto a position sensing detector 74, which may be any suitable conventional light-sensitive device, to provide a signal indicating the angular position (as shown in FIG. 8) of the beam 50 received by the prism 72. A signal corresponding to the place on the elongated position sensing detector 74, where the reflected beam 50 (after passing through the prism 72) strikes the detector 74, then is supplied by any suitable means to a microprocessor 76. The microprocessor processes this data and provides a graphic display, on a graphic display surface 78, of the orientation of the ball-striking surface of the putter head 10. The graphic display 78 may take any of a number of different forms. For example, it could include a graphic picture of an angular orientation of the type shown in FIGS. 5, 6 and 7. On the other hand, it could be in the form of digital information specifying angular deviation from the desired alignment, or any other desired form intended to communicate to the user (the golfer using the putter head 10) the necessary information to allow the user to adjust those aspects of his or her swing needed to bring about the desired results. Memory storage of multiple putts also may be provided, if desired.

The foregoing description of the preferred embodiments of the invention is to be considered as illustrative and not as limiting. Various changes and modifications will occur to those skilled in the art for performing substantially the same function, in substantially the same way, to achieve substantially the same result without departing from the true scope of the invention as defined in the appended claims.

What is claimed is:

1. A method for determining the aiming tendencies during putting including the steps of:

placing a mirror on the toe of a putter head in a position perpendicular to the ball-striking surface of the putter head;

providing a collimated beam of light from a source at right angles to an imaginary line between a ball to be putted and the target hole;

positioning the collimated beam of light to strike the mirror on the putter head when the head is at a position to strike a ball;

receiving a reflected beam of collimated light from the mirror on the putter head as it is reflected from the mirror back toward the source providing the collimated beam of light; and providing an indication of the putter head orientation from the reflected beam of light at the position where the putter head strikes the ball.

2. The method according to claim 1 wherein the step of placing a mirror on the toe of the putter head involves temporarily placing a mirror on the toe of the putter head.

3. The method according to claim 2 wherein the step of providing a collimated beam of light provides a beam of laser light.

4. The method according to claim 3 further including the step of reflecting the received beam of light upwardly to provide the indication of putter head orientation.

5. The method according to claim 3 wherein the step of providing an indication of the putter head orientation includes providing a position-sensing detector for receiving the reflected beam of light from the mirror on the putter head, and displaying the indication of putter head orientation on a graphic display.

6. The method according to claim 1 further including the step of reflecting the received beam of light upwardly to provide the indication of putter head orientation.

7. The method according to claim 1 wherein the step of providing a collimated beam of light provides a beam of laser light.

8. The method according to claim 1 wherein the step of providing an indication of the putter head orientation includes providing a position-sensing detector for receiving the reflected beam of light from the mirror on the putter head, and displaying the indication of putter head orientation on a graphic display.

9. A system for assisting a golfer in determining aiming tendencies during putting including in combination:

a mirror attached to the toe of a putter head in a position perpendicular to the ball-striking surface of the putter head;

a source of a collimated beam of light located at right angles to an imaginary line between a ball to be putted and a target hole and positioned to direct the beam of light to the mirror on the toe of the putter head when the head is at a position to strike a ball;

a receiving device located adjacent the source of the collimated beam of light for receiving a reflected beam of light from the mirror on the putter head; and an indicator device coupled with the receiving device for providing an indication of putter head orientation at the position where the putter head strikes a ball.

10. The system according to claim 9 wherein the mirror placed on the toe of the putter head comprises a mirror attached to a leg at right angles thereto, wherein the leg is attached to the edge of the ball-striking surface and the mirror extends at right angles thereto over the toe of the putter head.

11. The system according to claim 10 wherein the mirror is temporarily attached to the putter head.

12. The system according to claim 11 wherein the mirror is attached to the putter head with releasable adhesive.

13. The system according to claim 12 wherein the mirror is made of lightweight plastic.

14. The system according to claim 13 wherein the receiving device includes a reflective surface having an aperture in it through which the collimated beam of light is transmitted, and wherein the reflective surface is located at an angle of 45° to the collimated beam of light for reflecting upwardly the reflected beam of light from the mirror on the putter head.

15. The system according to claim 14 wherein the indication of putter head orientation is provided on an opaque window located above the reflective surface.

16. The system according to claim 13 wherein the indicator device comprises a graphic display.

17. The system according to claim 9 wherein the receiving device includes a reflective surface having an aperture in it through which the collimated beam of light is transmitted, and wherein the reflective surface is located at an angle of 45° to the collimated beam of light for reflecting upwardly the reflected beam of light from the mirror on the putter head.

18. The system according to claim 17 wherein the indication of putter head orientation is provided on an opaque window located above the reflective surface.

19. The system according to claim 18 wherein the device providing the collimated beam of light is a source of laser light.

20. The system according to claim 9 wherein the indicator device comprises a graphic display.

21. The system according to claim 20 wherein the device providing the collimated beam of light is a source of laser light.

22. The system according to claim 9 wherein the device providing the collimated beam of light is a source of laser light.

23. The system according to claim 9 wherein the mirror is temporarily attached to the putter head.

* * * * *